United States Patent [19]

Laempe

[11] Patent Number: 4,815,517

[45] Date of Patent: Mar. 28, 1989

[54] CORE MAKING MACHINE

[76] Inventor: Joachim Laempe, Gewerbegebiet Grienmatt, D-7860 Schopfheim, Fed. Rep. of Germany

[21] Appl. No.: 82,789

[22] Filed: Aug. 6, 1987

[30] Foreign Application Priority Data

Aug. 8, 1986 [DE] Fed. Rep. of Germany ..... 3626994

[51] Int. Cl.[4] ..... B22C 15/24

[52] U.S. Cl. ..... 164/200; 164/339

[58] Field of Search ..... 164/7.1, 137, 200, 201, 164/202, 253, 339, 341, 342; 239/397; 248/363

[56] References Cited

U.S. PATENT DOCUMENTS 2,793,409 5/1957 Hansberg ..... 164/201

3,167,992 2/1965 Kury ..... 248/363

FOREIGN PATENT DOCUMENTS 869937 10/1981 U.S.S.R. ..... 164/200

*Primary Examiner*—Richard Seidel

*Attorney, Agent, or Firm*—Peter K. Kontler

[57] ABSTRACT

A core making machine wherein a selected blow plate is attracted to the blow head by suction and/or by one or more magnets so that the connection between the blow head and the plate can be terminated or established practically instantaneously without the utilization of screws, bolts and nuts, clamps, hooks or other conventional fasteners.

18 Claims, 2 Drawing Sheets

CORE MAKING MACHINE

CROSS-REFERENCE TO RELATED CASE

The core making machine of the present invention is substantially identical with that which is described and shown in the commonly owned copending application Ser. No. 082,847 filed Aug. 8, 1987 for "Core making machine", now abandoned.

BACKGROUND OF THE INVENTION

The invention relates to core making machines of the type wherein a blow head is used to direct sand in a pressurized gaseous carrier medium into a core box by way of a blow plate. More particularly, the invention relates to improvements in core making machines of the type disclosed, for example, in U.S. Pat. No. 2,705,821 to Peterson.

It is known to supply a core making machine with a set of different blow plates wherein the openings are distributed in a manner to ensure proper introduction of molding sand into selected core boxes. A foundry normally employs hundreds of different core boxes and blow plates, and the core making machine is provided with means for separably connecting its blow head with a selected blow plate. Such connecting means normally includes screws which secure the marginal portion of a selected blow plate to the adjacent portion of the blow head. The unit including the blow head and the selected blow plate, which is affixed to the blow head, is thereupon attached to a so-called sand head or to any other suitable device which supplies to the blow head at least one stream of sand in a gaseous carrier medium for admission into a core box by way of one or more openings in the selected blow plate. As a rule, the interval of time which is required to replace a blow plate with a different blow plate is between 10 and 40 minutes, depending on the size of the blow head and blow plate and on the number and nature of devices which are used to separably attach the blow plate to the blow head. Thus, each and every replacement of a blow plate entails a prolonged interruption of operation of the core making machine with attendant losses in output. The situation is aggravated if the fasteners which are used to separably connect the blow head with a selected blow plate and/or the fasteners which are used to separably connect the blow head to the means for supplying molding sand become contaminated or corroded by sand and/or as a result of exposure to moisture so that they cannot be readily detached or reapplied. This further prolongs the intervals of idleness of the core making machine. Still further, the connection between the blow head and a selected blow plate as well as the connection between the blow head and its carrier (such as a sand head) is likely to develop leaks in response to repeated attachment and detachment of the blow head from the carrier and/or a blow plate; this entails uncontrolled escape of conveyed sand with the pressurized gaseous carrier medium and improper filling of a core box and/or contamination of the area around the machine. The threads of screws or similar fasteners, as well as the threads in tapped bores for the shanks of such threaded fasteners, are likely to be damaged or destroyed in response to repeated separation and reattachment of the blow head so that the blow head can become completely separated from its carrier or a selected blow plate can become completely detached from the blow head while the machine is in actual use.

German Pats. Nos. 972,225 (to Hansberg) and 1,177,291 (to Bachmann et al.) disclose core making machines wherein the manner of connecting blow plates to the blow head is not described and/or shown. It is assumed that the connections are separable.

German Pat. No. 930,104 to Hansberg discloses a core making machine wherein a selected blow plate can be separably connected to the blow head by a set of screws. This also applies for the connection of a selected blow plate to the blow head in the core making machine which is disclosed by Peterson.

As a rule, the blow head of a core making machine is a one-piece body (reference may be had, for example, to Bachmann et al. and Hansberg '104). This is considered to be desirable and necessary in order to reduce the number of parts as well as to reduce the likelihood of penetration and entrapment of sand between separable components. The discharge end of the sand head is directly adjacent the one-piece blow head. Such sand head can be removed only when the blow head is detached from its carrier, for example, a tubular housing for the sand head. The means for separably connecting the blow head to the carrier normally includes a set of screws. Since the replacement of a previously used blow plate with a different blow plate often necessitates the utilization of a different blow head as well as the utilization of a different sand head, each such change of setup involves a separation of the blow plate from the blow head which is installed in the core making machine, separation of the blow head from its carrier, removal of the sand head, insertion of a different sand head, attachment of a different blow head to the freshly inserted sand head, and attachment of a different blow plate to the freshly installed blow head. The reason that it is often necessary to replace a blow head with a different blow head and to simultaneously replace the sand head when the core making machine is to employ a different blow plate is that the distribution of openings in the freshly selected blow plate is or can be such that the previously used sand head and blow head cannot ensure adequate distribution of supplied sand to the openings so that the distribution of sand in the core box which is adjacent the freshly selected blow plate is unsatisfactory. If the total time which is taken up by a change of setup is between 10 and 40 minutes, a substantial part of such time is spent to separate the blow head from its carrier in order to gain access to the sand head. Moreover, it is customary to clean the sand head or an analogous sand supplying element on a daily basis. Each such cleaning operation must be preceded by detachment of the one-piece blow head from its carrier. This not only takes up much time but also necessitates repeated application and removal of fasteners which are used to separably connect the blow head to the carrier. Therefore, the useful life of such fasteners is relatively short. Moreover, and since the fasteners constitute or cooperate with means for centering the blow head on its carrier, the centering action invariably deteriorates with time as a result of extensive wear upon the fasteners and/or upon one or more centering elements which cooperate with the fasteners.

OBJECTS AND SUMMARY OF THE INVENTION

An object of the invention is to provide a core making machine wherein a blow plate can be replaced with a different blow plate within a minute fraction of the time which is required in conventional core making machines.

Another object of the invention is to provide a core making machine wherein the parts which couple a selected blow plate to the blow head can stand much longer periods of use than the connection between the blow head and a selected blow plate in a conventional core making machine.

A further object of the invention is to provide the improved core making machine with novel and improved means for separably connecting the blow head to its carrier, such as the part or parts which supply the blow head with a stream of sand in a pressurized gaseous carrier medium.

An additional object of the invention is to provide the improved machine with novel and improved means for coupling a selected blow plate to the blow head in such a way that the condition of the coupling means is not adversely affected by repeated separation of blow plates from the blow head and attachment of fresh or different blow plates.

Still another object of the invention is to provide the machine with a novel and improved blow head, with novel and improved blow plates and with novel and improved means for supplying sand to the blow head.

A further object of the invention is to provide a novel and improved method of separably coupling a selected blow plate to the blow head of a core making machine.

An additional object of the invention is to provide the machine with means for practically instantaneously establishing or terminating a connection between the blow head and a selected blow plate.

The invention is embodied in a core making machine which serves to pneumatically convey sand into core boxes. The improved machine comprises a blow head member having sand admitting inlet means and sand discharging outlet means, means for supplying to the inlet means sand in a gaseous carrier medium, a blow plate member, and means for separably coupling the plate member to the head member adjacent the outlet means. In accordance with a feature of the invention, the coupling means includes means for attracting the plate member to the head member, i.e., the coupling means need not employ screws, bolts, bolts and nuts, clamps, hooks, pawls or like separably or pivotably mounted parts which must be manipulated in order to attach the plate member to the head member as well as to detach the plate member from the head member.

In accordance with one presently preferred embodiment of the invention, the coupling means includes means for attracting the plate member to the head member by suction. To this end, the head member and the plate member are respectively provided with neighboring first and second surfaces and the attracting means can include at least one suction chamber in at least one of the surfaces and means (e.g., a vacuum pump or the like) for maintaining the pressure in the suction chamber below atmospheric pressure. At least the first surface surrounds the outlet means of the head member, and the machine preferably further comprises sealing means which is interposed between the first and second surfaces and at least partially surrounds the suction chamber. The suction chamber can constitute a circumferentially complete annular chamber which surrounds the outlet means of the head member, and the sealing means can include at least one first and at least one second annular sealing element. One of these elements surrounds the suction chamber and the other sealing element is surrounded by the suction chamber.

Alternatively or in addition to the means for attracting the plate member to the head member by suction, the coupling means can comprise at least one magnet. Such magnet can be provided in the head member or in the plate member (preferably in the head member) and can include or constitute an electromagnet. For example, the electromagnet can include one or more conductors in the form of windings which are at least partially recessed into the surface of the head member to at least partially surround the outlet means, and the plate member is then made of or contains a ferromagnetic material, at least in the region or regions adjacent the conductor or conductors of the electromagnet.

The head member preferably includes a substantially annular support having an annular surface which preferably constitutes the first surface (i.e., the attracting means is operative between the support and the plate member) and a substantially centrally located recess or socket surrounded by the annular surface. Such head member further comprises a nozzle which defines the inlet means and the outlet means and is preferably removably (loosely) received in the recess, preferably in such a way that it is confined in the recess solely by the adjacent portion of the plate member when the latter is attracted to the annular support of the head member. That surface of the nozzle which surrounds the outlet means is immediately adjacent or abuts the surface of the plate member. The plate member can be attracted to the support of the head member by suction and/or by one or more magnets. The nozzle can be made of or can contain a suitable plastic material.

The means for supplying sand can include a tubular member having a discharge end which is adjacent the inlet means and can directly abut the nozzle. To this end, the discharge end can be provided with a radially outwardly flaring collar abutting that (rear) surface of the nozzle which surrounds the inlet means and faces away from the plate member. Alternatively, the collar can be omitted and the discharge end of the tubular element can extend into a relatively shallow annular seat provided in the nozzle and surrounding the inlet means.

The means for supplying sand can further comprise a housing for the tubular element, and such housing can constitute or include an elongated tube into which the tubular element is telescoped and which has an enlarged annular end portion adjacent the head member. In accordance with one presently preferred embodiment of the invention, the nozzle directly abuts the end portion of the housing.

The machine further comprises means for securing the head member to the end portion of the housing, and such securing means preferably includes means for separably connecting the aforementioned annular support of the head member to the end portion of the housing. The connecting means can include one or more fasteners which are inclined with reference to or which are parallel with the axis of the tubular element of the sand supplying means. The support can include an annular portion which constitutes a bottom wall for the recess and surrounds the inlet means of the nozzle. Such annular portion has a side or end surface which faces the recess, and the fastener or fasteners can extend from the end surface of the annular portion, through the annular portion and into the end portion of the housing. Each fastener can have external threads and the end portion of the housing is then provided with a tapped bore or hole for each fastener.

If the discharge end of the tubular element has a radially outwardly flaring collar, such collar can abut the aforementioned end surface so that it is held between the annular portion of the support and the nozzle when the nozzle is held in its recess by the adjacent portion of the plate member. The nozzle can constitute a relatively short cylinder, and the support of the head member can be provided with a substantially cylindrical surface which bounds the recess between the aforementioned end surface and the aforementioned annular surface and surrounds the properly inserted nozzle.

If the nozzle should not directly abut the end portion of the housing for the tubular element, the nozzle abuts the aforementioned collar of the tubular element. The support can surround the end portion of the housing, or the aforementioned annular portion of the support can abut an end face of the housing between the nozzle and the housing. The housing is then provided with an opening through which the discharge end of the tubular element extends, either into the aforementioned seat of the nozzle or to enable its collar to abut the end surface in the recess of the support.

The novel features which are considered as characteristic of the invention are set forth in particular in the appended claims. The improved core making machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
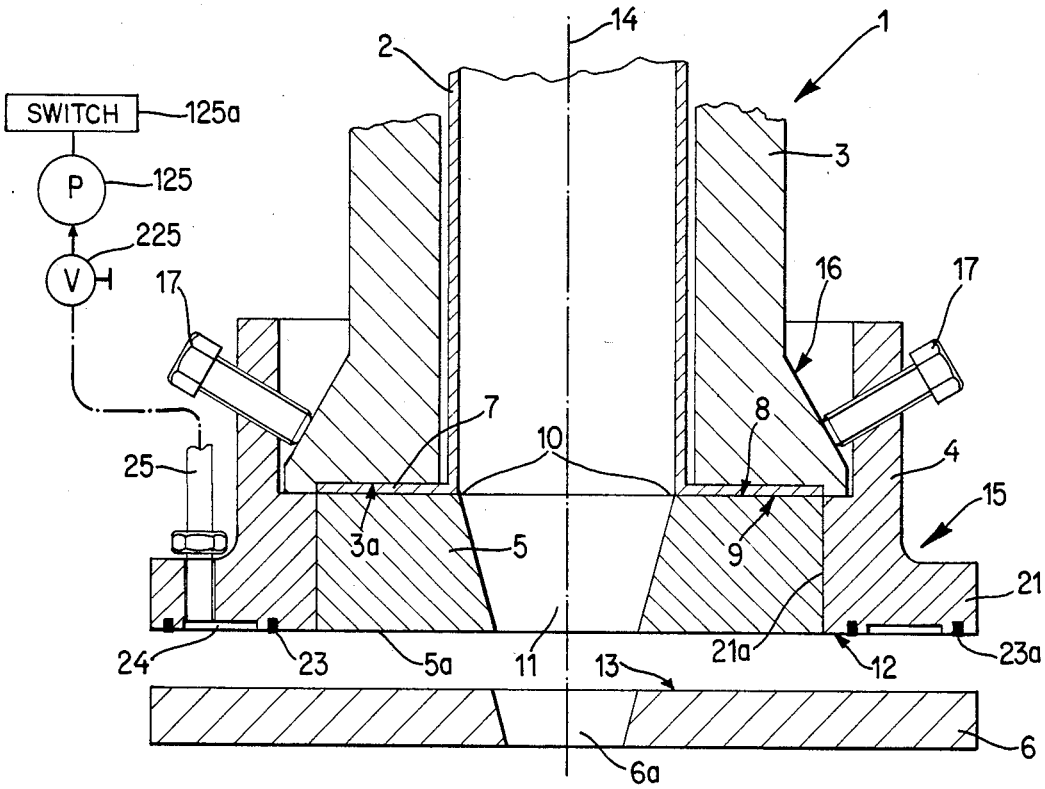
FIG. 1 is a fragmentary partly exploded vertical sectional view of a core making machine which embodies one form of the invention and wherein the blow plate member can be attracted to the support of the blow head member by suction.

The core making machine 1 of FIG. 1 comprises a composite blow head member 15 (hereinafter called head or blow head) with one or more sand admitting inlets at 10 and one or more sand discharging outlets at 11, a blow plate member 6 (hereinafter called plate or blow plate), a device for pneumatically supplying sand to the inlet or inlets 10 in a gaseous carrier medium and including a tubular sand conveying element 2 and a tubular housing 3 for the element 2, and novel and improved means for separably coupling the blow plate 6 to the blow head 15 adjacent the outlet or outlets 11. The housing 3 has an enlarged annular lower end portion 16 which is a hollow conical frustum and is separably connected to an annular support or flange 21 of the blow head 15 by several threaded fasteners 17 whose axes are inclined with reference to the axis 14 of through tapped bores which are provided in a substantially cylindrical sleeve-like skirt 4 of the head 15 and their tips abut the conical external surface of the enlarged annular end portion 16 of the housing 3. The support 21 has an annular surface 12 which surrounds the outlet or outlets 11 and faces the adjacent surface 13 of the blow plate 6. The aforementioned coupling means includes means for attracting the surface 13 to the surface 12 by suction and, to this end, the surface 12 is formed with a shallow circumferentially complete annular groove 24 which is surrounded by a first annular sealing element **23*a* and surrounds a second annular sealing element 23. These sealing elements are partially received in shallow annular grooves of the annular surface 12 so that they abut the surface 13 when the plate 6 is attracted to the head 15 in response to evacuation of air from the suction chamber including the groove 24. The means for evacuating air from the groove 24 (i.e., for maintaining the pressure in the groove 24 below atmospheric pressure) includes a vacuum pump 125 whose intake is connected to the support 21 by a suction pipe or conduit 25. The conduit 25 contains an adjustable valve 225 which can connect the groove 24 with the pump 125 or with the atmosphere. The character 125*a* denotes a switch which can be actuated to start or arrest the pump 125. The intake end of the conduit 25 communicates with a bore which is provided in the support 21 and communicates with the groove 24. The suction chamber includes the groove 24 as well as the space between the sealing elements 23, 23*a*. In fact, the groove 24 can be omitted because the sealing elements 23 and 23*a* can maintain the surfaces 12, 13 at a requisite distance from each other so that these surfaces define an annular suction chamber as soon as the plate 6 is moved sufficiently close to the head 15**.

The connection between the head 15 and plate 6 can be terminated in immediate response to disconnection of the pump 125 from the conduit 25 and/or in response to admission of atmospheric air into the suction chamber including the groove 24, either by way of the conduit 25 and valve 225 or elsewhere. Thus, the blow plate 6 can be properly coupled to or disengaged from the head 15 within a minute fraction of the time which is required to apply or detach one or more screws, bolts and nuts or analogous conventional fasteners. The area of the portion of the surface 12 between the sealing elements 23 and **23*a* is selected with a view to ensure that suction in the chamber including the groove 24 will suffice to reliably couple the plate 6 to the head 15 when the core making machine 1 is in actual use. The magnitude of the force with which the plate 6 is attracted to the support 21 of the head 15 can also be regulated by appropriate selection of the pressure differential between the suction chamber and the surrounding atmosphere. The magnitude of the force which is generated to attract the plate 6 to the head 15 will depend, to a considerable extent, upon the weight of the plate 6**.

It is clear that the surfaces 12 and 13 can define two or more circumferentially complete annular suction chambers or otherwise configurated suction chambers without departing from the spirit of the invention. For example, these surfaces can define two or more concentric annular suction chambers each of which can be individually connected to a discrete vacuum pump or to a common vacuum pump so that the magnitude of the force with which the plate 6 is attracted to the head 15 can be varied in stepwise fashion. Such suction chambers can be separated from each other by single or plural sealing elements so as to ensure that the development of a leak between one of several suction chambers and the surrounding atmosphere or between two neighboring suction chambers will not appreciably influence the force with which the head 15 attracts the plate 6. It is equally possible to provide one or more annuli of relatively small suction chambers each of which extends along a certain arc (as considered in the circumferential direction of the support 21). The neighboring suction chambers of one or more annuli of relatively short chambers can but need not overlap each other in the circumferential direction of the support 21. It is also possible to provide the groove 24, or two or more circumferentially complete or otherwise configurated grooves, in the surface 13 of the plate 6. This may be desirable in certain instances, e.g., to reduce the weight of the plate 6.

The annular surface 12 of the support 21 surrounds a recess 21*a* which is actually a bore or hole extending all the way through the support 21 and confining a discrete portion 5 of the blow head 15, namely a short cylindrical or elongated nozzle 5 which defines the aforementioned inlet or inlets 10 and outlet or outlets 11. The nozzle 5 has a front surface 5*a* which is preferably substantially flush with the surface 12 when the nozzle is properly received in its recess 21*a*, and the nozzle is held in such recess exclusively by the central portion of the blow plate 6 when the latter is attracted to the support 21 in response to evacuation of air from the chamber between the sealing elements 23 and 23*a*. At such time, the circular rear surface 8 of the nozzle 5 is adjacent to or lies flush against the flat underside 9 of a radially outwardly extending circular collar 7 forming part of the discharge end of the tubular element 2. The collar 7 is snugly and sealingly received in a shallow depression 3*a* in the end face of the enlarged annular end portion 16 of the housing 3. The nozzle 5 serves to guide the admitted particles of sand from the inlet or inlets 10 toward and through the outlet or outlets 11 and into the opening or openings 6*a* of the blow plate 6. The latter is then located on top of a core box (not shown) of any conventional design which can rest on a suitable base in a manner as disclosed and shown, for example, in the aforementioned patent to Peterson. The axial length of the nozzle 5 is preferably selected in such a way that its front surface 5*a* is flush with the annular surface 12 of the support 21 when the rear surface 8 abuts the collar 7 and the latter abuts the surface at the bottom of the depression 3*a* in the end portion 16 of the housing 3.

Cleaning of the preferably cylindrical nozzle 5 (whose axis preferably coincides with the axis 14 of the element 2) can take place immediately after the pressure in the suction chamber including the groove 24 is allowed to rise so that the plate 6 becomes separated from the support 21. The nozzle 5 can drop out of the recess 21*a* by gravity because it need not be positively secured to the support 21 and/or the skirt 4. Moreover, the nozzle 5 merely abuts the collar 7 at the discharge end of the tubular element 2.

The cost of the improved core making machine 1 need not exceed the cost of a conventional machine. All that is actually necessary is to provide one or more suction chambers between the surfaces 12, 13 of the blow head 15 and a selected blow plate 6 and to provide means (such as one or more pumps 125) for evacuating air from the suction chamber or chambers. The weight of the machine is actually reduced if one or more grooves are machined into the surface 12 or 13, and a reduction of weight is especially advantageous if one or more grooves 24 or similar or analogous grooves are provided in each blow plate because this facilitates manipulation of blow plates during transport to or from storage.

An advantage of the sealing elements 23, 23*a* is that their sealing action improves in response to progressing evacuation of air from the suction chamber including the groove 24.

A further advantage of the improved machine is that several of its components can be identical with or similar to the corresponding components of a conventional core making machine. Thus, if a conventional machine already employs a blow head with a flange-like support for a selected blow plate, such machine can be converted for operation in accordance with the present invention (i.e., so that the selected blow plate is merely attracted but need not be positively locked to the blow head) by the simple expedient of providing the blow head and/or each blow plate with means for defining one or more suction chambers when the selected blow plate is placed next to the outlet or outlets of the blow head, and providing means for evacuating air from the suction chamber or chambers. Conversion of a conventional core making machine for operation in accordance with the present invention can be carried out at a surprisingly low cost.

Figure 2:
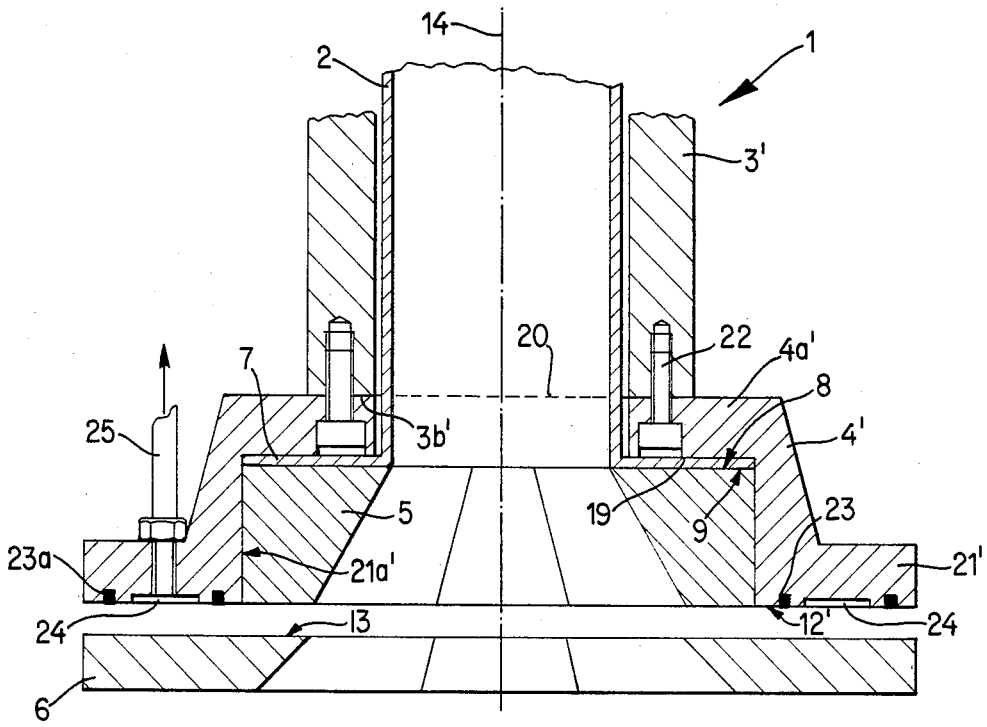
FIG. 2 is a similar fragmentary partly exploded vertical sectional view of a second core making machine wherein the blow head member has a modified support which is separably secured to a modified housing of the means for supplying sand to the inlet means of the head member.

The core making machine 1' of FIG. 2 employs a modified blow head 15' and a modified housing 3'. The manner in which the blow plate 6 can be pneumatically attracted to the support 21' of the cup-shaped head 15' is the same as described in connection with FIG. 1. The skirt 4' of the head 15' has a radially inwardly extending annular portion 4*a'* which abuts the end face 3*b'* of the housing 3' and is secured thereto by a set of axially parallel fasteners 22 in the form of screws. The bottom surface 19 of the annular portion 4*a'* is the end surface in the deepmost portion of the recess 21*a'*; this recess receives the nozzle 5 of the head 15' and the rear surface 8 of the nozzle abuts the underside 9 of the collar 7. The latter abuts the end surface 19 and conceals the heads of the screws 19. The character 20 denotes an opening in the annular portion 4*a'* of the support 21'; the discharge end of the tubular element 2 extends through and beyond the opening 20. When the blow plate 6 is attracted to the support 21' of the head 15', the central portion of such plate urges the nozzle 5 into the recess 21*a'* and the nozzle biases the collar 7 at the discharge end of the tubular element 2 against the surface 19 of the annular portion 4*a'*. Thus, the head 15' and the housing 3' can be lifted relative to the collar 7 as soon as the pressure in the groove 24 of the surface 12' is permitted to rise so that the plate 6 becomes separated from the support 21'. Alternatively, the tubular element 2 can be lowered with reference to the housing 3' and support 21' as soon as the blow plate 6 is permitted to become disengaged from the support 21' and the nozzle 5 is permitted to leave its recess 21*a'*. This also contributes to a shortening of assembling and dismantling times and renders it possible to convert the machine for use with a different blow plate 6 within a minute fraction of the time which is required for such operation in a conventional core making machine. The same holds true for the intervals of time which are necessary to dismantle the improved machine for the purpose of gaining access to selected parts, such as the nozzle 5, for inspection and/or cleaning.

Figure 3:
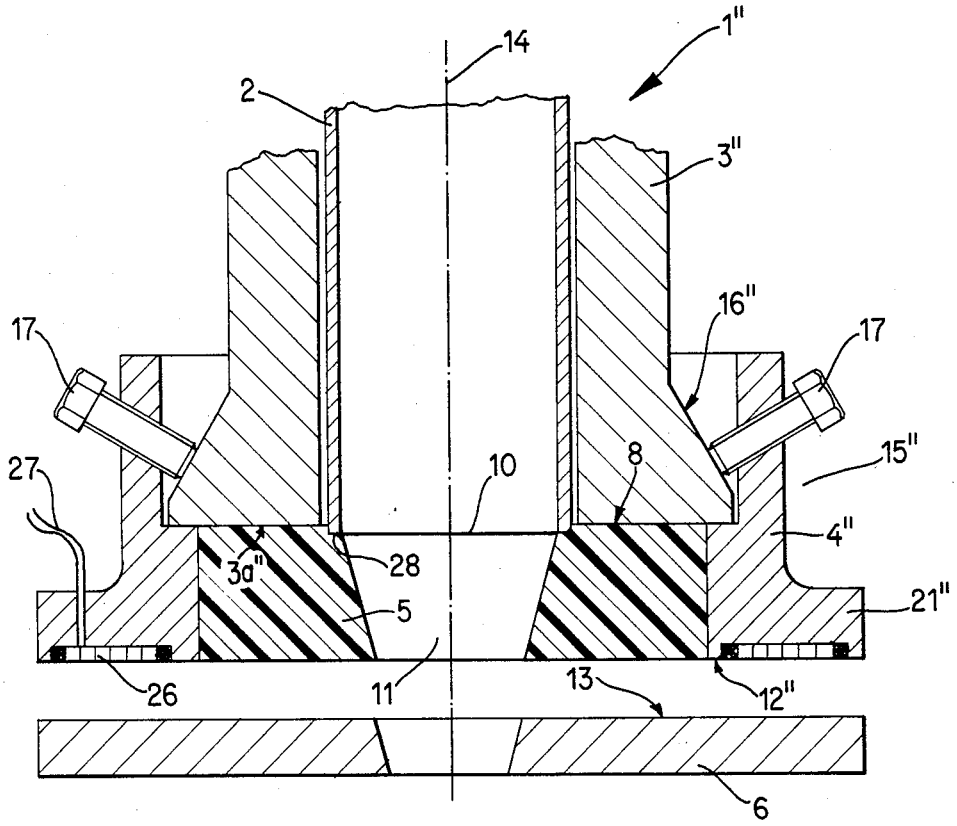
FIG. 3 is a similar fragmentary partly exploded vertical sectional view of a third core making machine wherein the blow plate member can be attracted to the support of the blow head member by one or more magnets.

FIG. 3 shows a core making machine 1'' which is similar to the machine of FIG. 1 except that it employs a somewhat different tubular element 2 and a somewhat different blow head 15''. In addition, the means for coupling the blow plate 6 to the support 21'' of the head 15'' includes an electromagnet 26 having one or more annular coil-shaped conductors which are recessed into the annular surface 12'' of the support 21'' and are connectable to a suitable energy source (not shown) by a cable 27. At least that portion of the plate 6 which is adjacent the conductors of the electromagnet 26 is made of or contains a ferromagnetic material so that the plate can be attracted to the support 21'' in immediate response to energization of the electromagnet. Inversely, the plate 6 is separated from the support 21'' in immediate response to deenergization of the electromagnet 26. Thus, the machine 1'' of FIG. 3 also allows for a substantial shortening of the interval of time which is required to assemble the plate 6 with the head 15'' or to detach the plate 6 in order to gain access to the nozzle 5 or to replace the illustrated plate 6 with a different plate. The rear surface 8 of the nozzle 5 abuts directly the end face **3*a*'' of the enlarged annular end portion 16'' of the housing 3''. The discharge end of the tubular element 2 is devoid of the collar 7 and is received in a shallow annular groove or seat 28 which is provided in the rear surface 8 and surrounds the inlet or inlets 10 of the nozzle 5**.

An advantage of the coupling means which employs one or more magnets is that the sealing elements 23 and **23*a* (whose useful life is likely to be short) can be omitted. The useful life of the sealing elements can be affected by the blow plate 6** when the latter bears against the sealing elements and/or by the conveyed granular material.

An advantage of the simplified tubular element 2 of FIG. 3 (which is devoid of a radially outwardly extending collar) is that such tubular elements can be even more rapidly extracted from the housing 3'', either upwardly or downwardly as seen in FIG. 3.

Another advantage of the coupling means which employs one or more magnets as a means for attracting a selected blow plate to the blow head is that the surfaces 12'' and 13 need not be machined with as high a degree of precision as if such surfaces were to define one or more suction chambers. Moreover, the development of dents, scratches and/or like damage to the surface 12'' and/or 13 does not affect the force with which the magnet or magnets attract a selected blow plate to the blow head 15''.

If the magnet or magnets are installed in the blow head 15'', the latter can cooperate with any conventional blow plate as long as the blow plate contains or consists of a ferromagnetic material so that it can be properly attracted to the support 21''. The magnet or magnets are preferably installed in the head 15'' because this reduces the overall cost of the machine (since it is not necessary to provide each of a hundred or more blow plates with one or more magnets) and also because it is simpler and more convenient to connect the normally stationary head 15'' to a source of electrical energy and to means for connecting the magnet or magnets in the head 15'' with or for disconnecting such magnet or magnets from the energy source.

The fasteners 17 which are shown in FIGS. 1 and 3 cooperate with the enlarged annular end portion 16 or 16'' of the respective housing 3 or 3'' in a manner as known from certain conventional core making machines. Since the axes of the fasteners 17 are inclined relative to the axes 14 of the respective tubular elements 2, and since the tips of these fasteners bear against the conical external surface of the enlarged annular end portion 16 or 16'' of the respective housing 3 or 3'', the fasteners 17 tend to pull the head 15 or 15'' upwardly (as seen in FIGS. 1 and 3) so that the internal shoulder of the skirt 4 or 4'' is urged against the underside of the annular end portion 16 or 16''.

An advantage of the connection which is shown in FIG. 2 and employs fasteners 22 which are parallel to the axis 14 of the tubular element 2 is that the fasteners are concealed when the core making machine 1' is in use and the head 15' cannot be accidentally loosened or completely detached from the housing 3'. Moreover, the enlarged end portion 16 of the housing 3 of FIG. 1 can be omitted because the end face **3*b*' of the tubular housing 3' can abut directly the outer side of the annular portion 4*a*' of the skirt 4'. The machine 1' of FIG. 2 can be simplified still further by replacing the illustrated tubular element 2 with the tubular element 2 of FIG. 3; the nozzle 5 of FIG. 2 is then preferably provided with a seat corresponding to the seat 28 of FIG. 3 in order to receive the collar-free discharge end of the tubular element 2 of FIG. 3**.

Concealment of the fasteners 22 is desirable and advantageous because they are less likely to be contaminated so that it would be difficult to remove them if the operators would decide to separate the head 15' from the housing 3'.

The nozzle 5 can be made of a metallic material or of a suitable plastic material. A relatively lightweight plastic nozzle is often desirable and advantageous because it renders it possible to reduce the forces which are required to attract a selected blow plate 6 to the head 15, 15' or 15'', i.e., to use a smaller vacuum pump or a weaker magnet. Moreover, the material of a plastic nozzle or of a plastic-coated nozzle can be selected in such a way that it can sealingly engage the adjacent surfaces of the blow plate, blow head, tubular element 2 or housing 3'' and thus confine the conveyed solid and gaseous substances to one or more predetermined paths, even if the surfaces around the plastic nozzle are rough or scratched due to wear or improper handling. In addition, a plastic nozzle is normally much less expensive than a metallic nozzle. Still further, a somewhat elastic plastic nozzle can sealingly engage the adjacent portion of the surface 13 on the selected blow plate 6; this is important when the coupling between the head and the plate operates with suction.

It has been found that, in many instances, the utilization of attracting means which operates with suction or the utilization of attracting means which operates with one or more magnets (such as one or more electromagnets) suffices to ensure reliable retention of a selected blow plate in an optimum position with reference to the support and with reference to the nozzle of the adjacent blow head. However, it is equally within the purview of the invention to use suction-operated attracting means jointly with one or more electromagnets, for example, if the blow head is to attract a large and heavy blow plate.

It was also ascertained that the improved coupling between the blow head and a selected blow plate renders it possible to replace the blow plate within an interval of less than twenty seconds. The pneumatic and/or magnetic forces which are generated to attract a selected blow plate to the blow head can be readily distributed in such a way that the blow plate is uniformly attracted to the support of the blow head all the way around the outlet or outlets of the nozzle 5. This greatly reduces the likelihood of escape of sand laterally between the surfaces 12, 13 which are shown in FIG. 1 or between the corresponding pairs of surfaces in the machines 1' and 1'' of FIGS. 2 and 3. Still further, the cost of installing the improved coupling means is surprisingly low, especially if one considers the advantages of the improved machine, particularly the drastic shortening of the interval of time which is required for attachment or separation of a blow plate or for a dismantling to the extent which is necessary to gain access to the nozzle 5 and/or to other parts for the purposes of inspection and/or cleaning.

The manner of separably securing the head 15 or 15'' to the housing 3 or 3'' by fasteners 17 which are inclined with reference to the axes of the respective tubular elements 2 is desirable and advantageous when a conventional core making machine is converted for operation in accordance with the present invention. Thus, all that is necessary is to replace the blow head of a conventional machine with the blow head 15 or 15'' and to secure such blow head to the housing 3 or 3'' by two or more fasteners 17. These fasteners serve as a means for securing the blow head to the housing as well as to center the blow head on the housing. To this end, the housing 3 or 3'' is normally furnished with a so-called centering ring which is subject to wear under the action of the fasteners 17 so that its useful life is relatively short or that its centering action is less satisfactory and the attachment of head 15 or 15'' to the respective housing 3 or 3'' takes up increasingly longer intervals of time and becomes more tedious and more complex during each renewed application of the blow head to its housing.

The housing 3' and the blow head 15' of FIG. 2 are preferably used in newly designed (non-converted) core making machines. The housing 3' is simpler than the housing 3 or 3'', and the fasteners 22 can be fully concealed so that they are less likely to be affected by sand and/or other corrosive or abrasive substances which could shorten their useful life and/or prevent rapid removal of such fasteners if and when the blow head 15' is to be separated from the housing 3'. Moreover, the aforementioned centering ring can be omitted and the centering action is not affected by the number of separations of the head 15' or by the number of reattachments of such head to the housing 3' because each fastener 22 invariably enters one of the axially parallel tapped bores in the end face **3*b'* of the end portion of the housing 3'. The dimensions of the annular portion 4*a'* of the skirt 4' and of the end portion of the housing 3' can be readily selected in such a way that the making of holes for the fasteners 22 does not affect the stability of the connection between the housing 3' and the blow head 15'. Two fasteners 22 (without a centering ring) suffice to ensure that the head 15' is properly centered with reference to the tubular element 2 and housing 3'**.

The length of the interval which is required to complete a change of setup depends on the period of time which is needed to replace a blow plate with a different blow plate as well as on the period of time which is needed to replace the means for supplying sand in a gaseous carrier medium if such replacement is necessary simultaneously with the replacement of a blow plate. In conventional core making machines, replacement of the sand head or of an analogous sand supplying element invariably requires complete separation of the blow head from its carrier, e.g., from the housing for the sand head. The need for complete detachment of the blow head from the housing for the tubular element 2 is avoided in my machine in that the support of the blow head is provided with a recess for the nozzle 5. Thus, and if the nozzle 5 must be replaced with a different nozzle whenever the blow head is to be connected with a different blow plate, such replacement of the nozzle takes up very little time because the nozzle is accessible and can drop out of its recess as soon as the application of a force to attract the blow plate to the support of the blow head is interrupted. The removed nozzle is then replaced with a different nozzle which is best suited to convey sand to the newly selected blow plate.

Moreover, when the nozzle 5 is removed from or permitted to drop out of the support 21 or 21', the collar 7 of the tubular element 2 is immediately accessible and the entire tubular element can be extracted downwardly, as viewed in FIG. 1 or 2, for inspection or for replacement with a different tubular element. The situation is even simpler if the core making machine employs the tubular element of FIG. 3 because such tubular element can be withdrawn from the housing 3'' in an upward direction or downwardly. Extraction of the tubular element 2 downwardly (i.e., through the support 21'') is possible as soon as the nozzle 5 is removed or permitted to fall out of its recess in the support 21''. The just described mode of gaining access to and of removing the tubular element 2 takes up but a minute fraction of the time which is required in a conventional core making machine to remove the screws which secure the blow head to the housing for the sand head before the sand head can be reached for removal from its housing.

The provision of a composite blow head 15, 15' or 15'' wherein the support 21, 21' or 21'' has a recess for the nozzle 5 renders it possible to gain access to the tubular element 2 while the major portion (support) of the blow head remains attached to its carrier (housing 3, 3' or 3''). Thus, once the blow plate 6 is detached from the support of the blow head and the nozzle 5 has been caused or permitted to leave its recess in the support, the tubular element 2 can be withdrawn in a forward (downward) direction because, when it conveys a stream of sand, it abuts exclusively the rear surface 8 of the nozzle 5 and need not be positively connected to the housing and/or to the support of the blow head. The situation is even simpler in the embodiment of FIG. 3 wherein the discharge end of the tubular element 2 does not have a collar so that it is merely inserted into the annular seat 28 in the rear surface 8 of the nozzle 5.

Immediate accessibility and removability of the tubular element 2 as soon as the nozzle 5 is removed from the recess of the support is of advantage in connection with the changes of setup as well as when the tubular element is to be cleaned which, as mentioned above, normally takes place on a daily basis. Furthermore, and since the support of the blow head can remain attached to its carrier, the wear upon the fasteners (be it the screws 17 or the screws 22) is minimal and such screws can stand long periods of use, especially if they are normally concealed in a manner as shown in FIG. 2 which employs the aforediscussed substantially cup-shaped support 21' and wherein the heads of the axially parallel fasteners 22 are concealed by the collar 7 as well as by the nozzle 5.

Since the front surface 5a of the nozzle 5 is preferably flush with the surface 12, 12' or 12'' of the respective support (i.e., the composite blow head of the present invention presents to the selected blow plate a practically uninterrupted surface including the surface 5a), the improved blow head can be used with all or nearly all conventional blow plates without risking the escape of large quantities of sand between the blow plate and the blow head.

The likelihood of uncontrolled escape of sand and/or gaseous carrier medium along the rear surface 8 of the nozzle 5 is remote regardless of whether the tubular element has a discharge end with a flange 7 or a simple cylindrical discharge end as shown in FIG. 3. In FIGS. 1 and 2, the flange 7 is confined between the rear surface 8 of the nozzle 5 and the bottom surface in the depression 3a of the housing 3 (FIG. 1) or between the rear surface 8 of the nozzle 5 and the surface 19 of the annular portion 4a' of the cup-shaped support 21' (FIG. 2). In FIG. 3, the discharge end of the element 2 fits into the seat 28 in the rear surface 8 of the nozzle 5 and the latter abuts the end face 3a'' of the enlarged end portion 16'' of the housing 3''.

The improved core making machine can embody only the novel (magnetic and/or suction-operated) means for coupling a selected blow plate to the support of the blow head, only the improved composite blow head (with the thus achieved ready accessibility and removability of the tubular element of the sand supplying means), or the novel coupling means as well as the improved blow head.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim;

1. A machine for pneumatically conveying sand into core boxes, comprising a blow head member having sand admitting inlet means and sand discharging outlet means; means for supplying sand to said inlet means; a blow plate member, said members respectively having neighboring first and second surfaces; and means for separably coupling said plate member to said head member adjacent said outlet means, said coupling means including means for attracting said plate member to said head member by suction, said attracting means including at least one annular suction chamber provided in at least one of said surfaces and means for maintaining the pressure in said chamber below atmospheric pressure, said at least one surface and said suction chamber surrounding said outlet means.

2. The machine of claim 1, means; and further comprising sealing interposed between said surfaces and at least partially surrounding said chamber.

3. The machine of claim 2, wherein said suction chamber is a circumferentially complete annular chamber, said sealing means including first and second annular sealing elements one of which surrounds said chamber and the other of which is surrounded by said chamber.

4. The machine of claim 1, wherein said head member includes a support having an annular surface constituting one of said first and second surfaces and confronting said plate member, and a recess surrounded by said annular surface, said head member further including a nozzle removably received in said recess and defining said outlet means.

5. The machine of claim 4, wherein said plate member has a surface constituting the other of said first and second surfaces and abutting or being closely adjacent said annular surface, said nozzle having a surface which abuts or is closely adjacent the surface of said plate member.

6. The machine of claim 4, wherein said attracting means includes means for attracting said plate member to said support.

7. The machine of claim 4, wherein said nozzle includes a plastic material and is held in said recess by said plate member, said attracting means including means for attracting said plate member to said support.

8. The machine of claim 4, wherein said inlet means is defined by said nozzle and said supplying means includes a tubular element having a discharge end adjacent said inlet means and abutting said nozzle.

9. The machine of claim 4, wherein said inlet means is defined by said nozzle and said nozzle has an annular seat surrounding said inlet means, said supplying means including a tubular element having a discharge end in said annular seat.

10. The machine of claim 4, wherein said supplying means includes a tubular element having a discharge end adjacent said inlet means and a housing for said tubular element; and further comprising means for securing said head member to said housing, said nozzle abutting said housing.

11. The machine of claim 10, wherein said housing includes a tube and said tubular element is telescoped into said tube, said tube having an enlarged end portion abutting said nozzle and said securing means including means for separably connecting said support to said end portion.

12. The machine of claim 1, wherein said supplying means includes a tubular element having a discharge end adjacent said inlet means and a housing for said tubular element, said housing having an annular end portion abutting said head member; and further comprising means for securing said head member to said end portion including at least one fastener substantially parallel to the axis of said tubular element.

13. The machine of claim 12, wherein said head member includes an annular support having an annular surface constituting one of said first and second surfaces and confronting said plate member, and a recess surrounded by said annular surface, said support including an annular portion constituting the bottom wall in said recess and having an end surface facing said recess, said head member further comprising a nozzle removably installed in said recess and defining said outlet means, said fastener extending from said end surface, through said bottom wall and into the end portion of said housing.

14. The machine of claim 13, wherein said fastener has external threads and said annular end portion has a tapped bore for said fastener.

15. The machine of claim 1, wherein said head member includes an annular support having an annular surface constituting one of said first and second surfaces and confronting said plate member, said support having a recess surrounded by said annular surface and said head member further comprising a nozzle defining said inlet means and said outlet means and removably received in said recess, said support further having an end surface disposed in said recess and surrounding the inlet means of said nozzle, said plate member having a surface which constitutes the other of said first and second surfaces and overlies the annular surface of said support and the nozzle in said recess, said attracting means including means for attracting said plate member to said support, said supplying means including a tubular element having a discharge end provided with a radially outwardly extending collar disposed in said recess intermediate said end surface and said nozzle.

16. The machine of claim 15, wherein said support has a substantially cylindrical surface bounding said recess and surrounding said nozzle.

17. The machine of claim 15, wherein said supplying means further comprises a housing for said tubular element, said support including an annular portion which is adjacent said end surface and said housing having an end portion abutting said annular portion opposite said end surface.

18. The machine of claim 17, wherein said tubular element has a discharge end including said collar and extending beyond said end portion of said housing, said housing having an opening for said discharge end.

* * * * *